United States Patent [19]

Lehman, Jr.

[11] 4,313,309

[45] Feb. 2, 1982

[54] TWO-STAGE REFRIGERATOR

[76] Inventor: Robert D. Lehman, Jr., c/o Vacudyne Industries Corp., 31 Heisser Ct., Farmingdale, N.Y. 11735

[21] Appl. No.: 96,644

[22] Filed: Nov. 23, 1979

[51] Int. Cl.[3] ..... F25B 7/00

[52] U.S. Cl. ..... 62/175; 62/203; 62/335

[58] Field of Search ..... 62/175, 203, 335

[56] References Cited

U.S. PATENT DOCUMENTS 2,434,221 1/1948 Newton ..... 62/175

2,456,386 12/1948 Cooper ..... 62/175

*Primary Examiner*—William E. Wayner

[57] ABSTRACT

A two-stage refrigerator for medicine or similar material storage in the known operation of which the high stage chills the refrigerant of the low stage so that extremely low temperatures can be obtained in the freezer compartment. In a departure from present practice, both stages, not just the low stage, have an on-off operating mode in response to the freezer compartment temperature, with the result that there is a significant reduction in the consumption of electrical power by the unit.

1 Claim, 4 Drawing Figures

TWO-STAGE REFRIGERATOR

The present invention relates generally to improvements for a two-stage refrigerator, and more particularly to an improved operational mode thereof, that is not merely not in current use but is contrary to present practice or recommendation, but which operational mode contributes to significant savings in the electrical power consumed by the refrigerator.

In connection with extremely low temperature refrigerators to which the within improvements are to be applied, use is made of a high stage refrigeration system to cool the refrigerant of the low stage, or else such refrigerant could not provide the extremely low temperatures necessary for effective use of the refrigerator. It is undoubtedly due to this requirement that all operating instructions, without exception, caution against ever discontinuing operation of the high stage, even though the low stage operation is always intermittent because it is in demand due to the changing temperature in the freezer compartment. This practice is premised, mistakenly as it is hereinafter demonstrated, on the belief that it is necessary always to have the high stage available as an effective and immediate heat sink for the low stage whenever it is started after a period of non-operation.

Underlying the present invention is the recognition that continuous operation of the high stage is not necessary to achieve immediate use of a properly pre-cooled low stage refrigerant. This result is achieved alternatively by the location of the heat exchanger of the unit adjacent the freezer compartment, and thus under the cooling influence thereof. An equally important discovery is that operating the high stage on the same intermittent basis as the low stage not only obviates an unnecessary consumption of power for such high stage, but it also significantly reduces power consumption for the low stage by minimizing the duration that it must be operated, all as is subsequently explained in detail.

Broadly, it is an object of the present invention to provide an improved two-stage refrigerator that is effective even without a continuously operated high stage and which, in other respects as well, overcomes the foregoing and other shortcomings of the prior art. Specifically, it is an object to provide a two-stage refrigerator capable of operating at commercially required extremely low temperatures, and which nevertheless is characterized by significantly reduced electrical power consumption.

Operational mode improvements demonstrating objects and advantages of the present invention are to be applied to a refrigerating unit of the type used in a room environment and having wall means bounding a freezer compartment for the storage of materials requiring extremely low temperature refrigeration. Such unit is comprised of a high stage refrigeration system having coil means respectively providing refrigerant compression and evaporation phase changes and of a low stage refrigeration system having coil means respectively similarly providing refrigerant compression and evaporation phase changes but at lower temperatures. In the known operational mode of such unit, the low stage evaporation coil means is located in refrigerating adjacent relation to the freezer compartment. Also the condenser coil means of the low stage and the high stage evaporation coil means are located in heat exchange relation to each other, and both said coil means also are located in adjacent relation to the freezer compartment.

The within inventive improvements in the aforesaid operational mode includes providing a temperature-sensitive probe in the freezer compartment, and control means connected from said probe in controlling relation to both said high and low stage refrigeration systems so as to simultaneously terminate the operation of both said systems upon the achievement of a selected temperature in the freezer compartment. Thus, incident to the termination of the operation of the high stage refrigeration system there is a corresponding termination of the dissipation of heat from the condenser coil means thereof. In this manner, there is thus obviated any adverse effect of the high stage condenser coil heat dissipation and although both stages are intermittently operated, they nevertheless are maintained in proper condition even during non-operating periods, so as to again resume simultaneous and immediately-effective operation, due to the cooling of the refrigerants thereof by the freezer compartment.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 3:
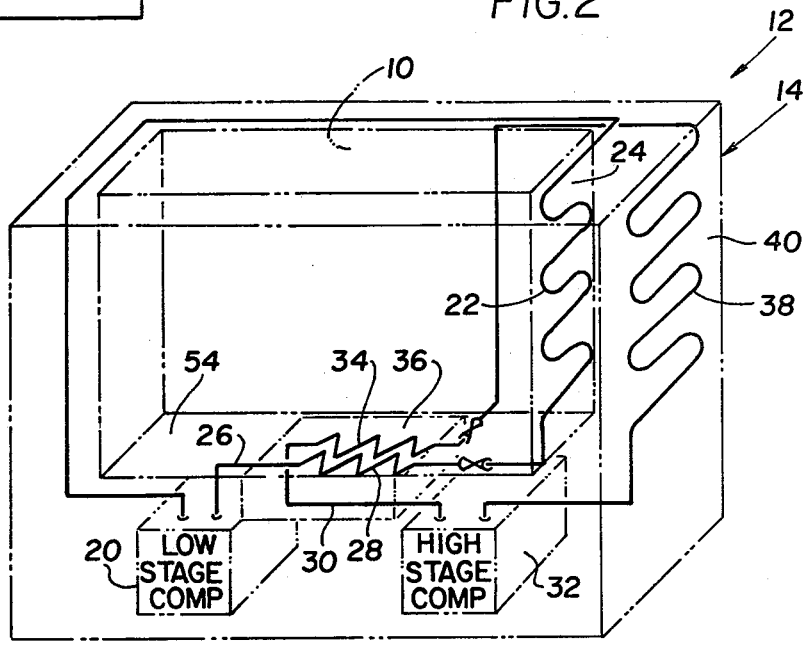
FIG. 3 is a perspective view which illustrates in somewhat simplified fashion the physical arrangement of the so-called "high" and "low" stage refrigeration systems that constitute the within two-stage refrigerator.

There are already commercially available numerous models of so-called two-stage refrigerators, one such model being designated "ULT 700 Series" and sold by the Scientific and Industrial Division of Revco, Inc. of Columbia, S.C. This known prior art refrigerator, as exemplified by the diagrammatic illustration of FIG. 3, is commonly used in laboratories or hospitals, within a room environment, to store medicines, vaccines or the like under extremely low temperatures in a freezer compartment 10. That is, the refrigerator per se, generally designated 12, has an external housing 14 which bounds the referred to internal freezer compartment 10. Not only is the construction of a typical two-stage compressor 12 well understood, but also well understood is its operational mode insofar as attaining the extremely low temperatures for the freezer compartment 10 that are necessary for proper storage of medicines, vaccines and similar materials.

To facilitate an understanding of the improvements in operating the refrigerator 12 from which there is derived significant savings in the electrical energy consumed by the refrigerator 12, certain aspects of the operation thereof should be, and now will be noted. To obtain very low temperatures in the freezer compartment 10, two separate refrigeration systems are utilized, namely a so-called "high stage" and a "low stage". Both stages, as is well understood, provide refrigerant compression and evaporation phase changes in order to produce a refrigerating effect. As the name implies, however, the high stage refrigeration system, soon to be described, produces these refrigerant phase changes at comparatively high temperatures, whereas the low stage refrigeration system provides these phase changes at considerably lower temperatures. More particularly, it is the low stage refrigeration system which is effective in causing an evaporation phase change in the refrigerant at significantly low temperature, which is primarily responsible for the corresponding low temperature produced by this refrigerant in the freezer compartment 10.

As further explanation for the above, and still referring to FIG. 3, the two-stage refrigerator 12 thus includes a low stage compressor 20 having an outlet conduit for the refrigerant thereof which in a length portion, designated 22, presents evaporator coils that are embodied in a wall 24 bounding the freezer compartment 10 and, in this advantageous location thus are effective, when the refrigerant changes phase from liquid to vapor, to absorb heat from the compartment 10 and thus significantly lower the temperature thereof. Between the low stage compressor 20 and the evaporator coils 22, the closed-loop conduit of the low stage refrigeration system 26 also includes coils 28 which are effective in condensing the refrigerant thereof, and thus in changing its phase from vapor to liquid. As is well understood, the vapor-to-liquid phase change entails the dissipation of heat, and it is essential that an optimum maximum amount of heat be removed from the low stage refrigerant during its passage through the condenser coils 28 so that this refrigerant, in subsequently changing phase during passage through the evaporation coils 22, is at an optimum low temperature and thus in condition to achieve a correspondingly optimum low temperature in the freezer compartment 10. In recognition of the need to condense the low stage refrigerant in the condenser coils 28 without raising the temperature thereof, the practice is to utilize the evaporation coils of the high stage refrigeration system as a heat sink for the heat being dissipated by the low stage refrigerant as it passes through the condenser coils 28.

To the above end, and as is clearly illustrated in FIG. 3, the inlet conduit 30 to the high stage compressor 32 includes in a length portion thereof, designated 34, the evaporation coils of the system in which the high stage refrigerant changes from liquid into vapor and thus, while undergoing this phase change, absorbs heat. As clearly illustrated, the high stage evaporator coil means 34 is located in adjacent and thus heat exchange relation to the condenser coil means 28 of the low stage refrigeration system, said coil means being embodied in a conventional manner in a heat exchanger 36.

Although the beneficial aspect of having the high stage refrigeration system is to provide the heat-absorbing evaporator 34 for the condenser low stage refrigeration system, all as has just been noted, said high stage refrigeration system unavoidably must also include condensor coil means 38, a component from which there is heat dissipation as the high stage refrigerant changes phase from vapor to liquid. In an effort to minimize the adverse effect of the unavoidable heat dissipation that is occasioned during the functioning of the high stage condenser 38, said condenser is embodied in an external wall 40 so as to encourage the dissipation of the heat outwardly into the room environment of the unit 12, rather than internally and thus in the direction of the freezer compartment 10. At this point in the description it is also convenient to note, as illustrated in FIGS. 1, 2, that the construction of the freezer 12 contemplates appropriate heat insulating means 42 in an interposed and thus blocking position between the high stage condenser 38 and the low stage evaporator 22.

Figure 1:
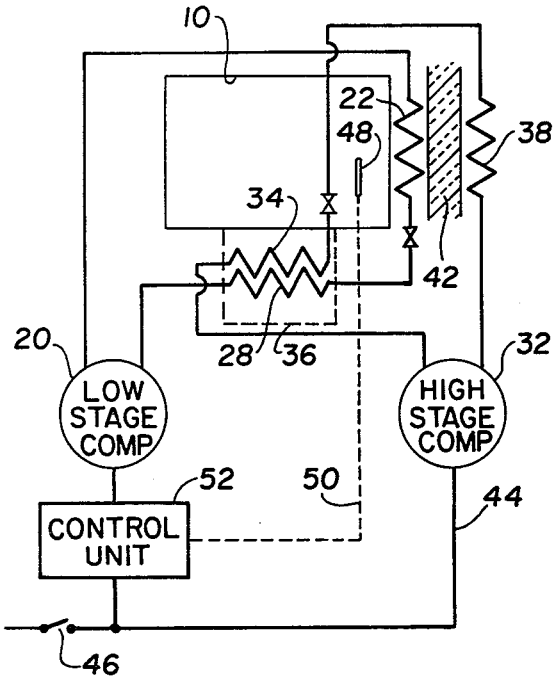
FIG.1 PRIOR ART
FIG. 1 is a combination circuit diagram and diagrammatic illustration of a prior art two-stage refrigerator to which the improvements of the present invention are advantageously applied.
Figure 2:
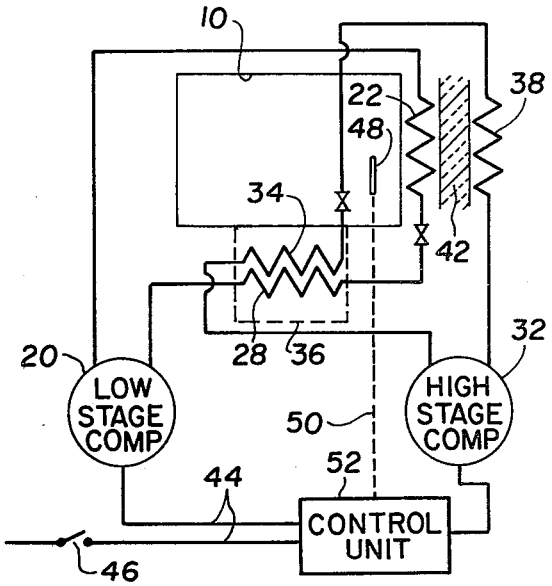
FIG. 2 is also a circuit diagram and diagrammatic illustration, but of a two-stage refrigerator embodying the improvements of the present invention.

Reference should now be made to FIG. 1 which includes additional details from which it can be better understood how the two-stage freezer 12 is operated in accordance with prior art practice. In FIG. 1 components already described in connection with FIG. 3 are designated by the same reference numerals and, for brevity's sake, the description thereof will not be repeated. As illustrated in circuit diagram convention, the compressors 20 and 32 of the two stages are electrically connected via an electrical conductor 44 to a source of electricity so as to be electrically operated upon the closing of the circuit switch 46. A temperature-sensitive probe 48, of known construction and operation, is located within the freezer compartment 10 and is operatively connected, as represented by the reference line 50, so as to effect, via a control unit 52, the starting and stopping of the motor of the low stage compressor 20. That is, and as is well understood, probe 48 is effective in sensing the temperature that exists within the freezer compartment 10 and in generating an appropriate signal to terminate the operation of the low stage compressor 20 when the desired low temperature exists in the compartment 10, and thereafter when said freezer compartment temperature rises, to again initiate the operation thereof.

In connection with the above, and as is evidenced by instructions in operation manuals of all manufacturers of two-stage refrigeratores of the type involved herein, without exception, the temperature-sensitive probe 48 has supervising control only over the operation of the low stage compressor 20. Stated another way, it is an undeviating prior art practice never to terminate the operation of the high stage compressor 32 on the belief, mistakenly for the reasons subsequently discussed, that it is necessary that this refrigeration system be continuously operational so that the evaporator coils 34 thereof are always in a condition to function as a heat sink for the refrigerant of the low stage refrigeration system. It is believed that unless this operational requirement is met, that when the low stage refrigeration system is commenced after a non-operating period that the refrigerant of such stage will not be at a low enough temperature within a reasonable short duration or period of time to provide the extremely low temperatures that are necessary for the refrigeration compartment 10.

An essential part of the within invention is a two-fold recognition; firstly, that the high stage refrigeration system need not be continuously operated in order to have immediate effective operation of the low stage refrigeration system and, secondly, that continuous operation of said high stage refrigeration system is a major factor contributing to the inefficient operation of the two stage refrigerator 12, particularly as to the unnecessary and wasteful use of electrical power. As to the latter, the wasted electrical energy is not only due to operating the high stage compressor 32 during periods when it is not necessary to do so, but there is also the wasting of electrical energy in order to eliminate the adverse consequence that unavoidably results from the continuous operation of the high stage refrigeration system.

Referring to either FIG. 1 or FIG. 2, in which similar components have been designated by the same reference numeral, particular note should be made of the relative location of the heat dissipating condenser coils 38 of the high stage refrigeration system, the refrigerating or evaporator coils 22 of the low stage refrigeration system, and the heat barrier or insulation material 42 in an interposed position therebetween. In the physical relationship just noted, no matter how much precaution is taken and no matter how effective the insulation 42, one of the discoveries which are a part of the within invention is that there is an unavoidable transfer of the heat being dissipated from the condenser 38 to the evaporator 22, despite the insulation 42. As a result, this unavoidable heat transfer causes an undesirable increase in the operating temperature of the freezer compartment 10 and this, in turn, necessitates operation of the low stage compressor 20 for a longer period than would otherwise be necessary. It is part of the within invention to propose as a solution that when the operation of the low stage compressor 20 is terminated, that there be simultaneously terminated the operation of the high stage compressor 32. To this end, it is to be specifically noted that the inventive operational arrangement for the two-stage refrigerator as illustrated in FIG. 2 calls for the control unit 52, which is operated by the temperature-sensitive probe 48, being electrically connected to the conductor 44 of the compressors 20 and 32 for both of the two refrigeration systems involved. Thus, when probe 48 indicates a low enough operating temperature within compartment 10 so that operation of the low stage compressor 20 can be dispensed with, the within invention contemplates that under these operating conditions that the operation of the high stage compressor 32 also will be temporarily discontinued. When the operation of the high stage compressor 32 is thus terminated this, of course, eliminates the condenser coils 38 as a source of heat, and thus effectively obviates the adverse consequences thereof.

It should be noted that field testing of a two-stage refrigerator operationally set up as illustrated in FIG. 2 has demonstrated that the refrigeration provided by the within two refrigeration systems is available almost immediately in response to an appropriate signal from the probe 48 which initiates the operation of the compressor components thereof. This, of course, is directly contrary to the prior art belief that the high stage refrigeration system must be continuously maintained in operation in order to obtain effective operation of the heat exchanger 36. In this regard, it is believed that favorable operation of the heat exchanger 36 is obtained despite non-operation of the high stage compressor 32 because of the close proximity of the heat exchanger 36 to the refrigeration compartment 10, all as is diagrammatically illustrated in two dimension in FIG. 2 and in three dimension in FIG. 3. That is, because the heat exchanger 36 is located adjacent the bottom wall 54 of the freezer compartment 10, the prevailing low temperature of compartment 10 supplies a chilling or refrigerating effect on the low stage condenser coils 28 thus keeping the refrigerant in these coils at an optimum low temperature, in much the same chilled condition that such refrigerant would be maintained if the evaporator coils 34 of the high stage refrigeration system was continuously maintained in operation, and thus the low stage refrigeration system is in condition to be immediately effective when its operation is commenced by the temperature-sensitive probe 48.

Figure 4:
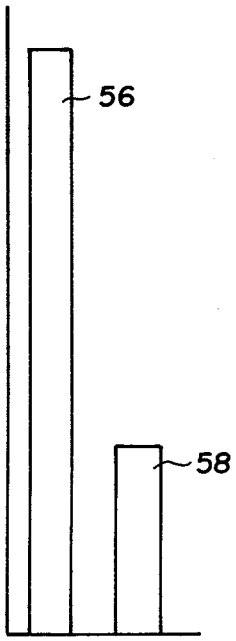
FIG. 4 is an instruction chart which illustrates the savings in electrical power resulting from operating the two-stage refrigerator in accordance with the present invention.

The remaining bar graph of FIG. 4 is included to demonstrate that the savings in electrical energy, as represented by the height of the bars, is more than just the energy saved by not continuously operating the high stage compressor 32. Thus, the energy consumed following the prior art practice, and as represented by the height of the bar 56, is more than double the energy consumption represented by bar 58, which illustrates the significantly diminished electrical energy required when operating intermittently both of the two stages of the refrigerator 12.

A latitude of modification, change and substitution is intended in the foregoing disclosure and in some instances some features of the invention will be employed without a corresponding use of other features. Accordingly, it is appropriate that the appended claim be construed broadly and in a manner consistent with the spririt and scope of the invention herein.

What is claimed is:

1. Improvements in the operational mode of refrigerating unit of the type used in a room environment and having wall means bounding a freezer compartment for the storage of materials requiring refrigeration, said unit being comprised of a high stage refrigeration system having coil means respectively providing refrigerant compression and evaporation phase changes, and a low stage refrigeration system having coil means respectively similarly providing refrigerant compression and evaporation phase changes but at lower temperatures, said operational mode including said low stage evaporation coil means being located in refrigerating adjacent relation to said freezer compartment and said condenser coil means thereof and said high stage evaporation coil means being located in heat exchange relation to each other and both said coil means also being located in adjacent relation to said freezer compartment, said improvements in said aforesaid operational mode comprising a temperature-sensitive probe operatively disposed in said freezer compartment, and control means connected from said probe in controlling relation to both said high and low stage refrigeration systems so as to simultaneously terminate the operation of both said systems upon the achievement of a selected temperature in said freezer compartment such that incident to the termination of the operation of said high stage refrigeration system there is a corresponding termination of the dissipation of heat from the condenser coil means thereof, whereby there is obviated the adverse effect of said high stage condenser coil heat disspation and both said systems are nevertheless maintained in proper condition to again resume simultaneous operation due to the cooling by said freezer compartment of said coil means in heat exchange relation with each other during said non-operating periods of said systems.

* * * * *